US007832846B2

(12) United States Patent
Hong et al.

(10) Patent No.: US 7,832,846 B2
(45) Date of Patent: Nov. 16, 2010

(54) PIEZOELECTRIC INKJET PRINTHEAD

(75) Inventors: Young-ki Hong, Anyang-si (KR); Jae-woo Chung, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 750 days.

(21) Appl. No.: 11/755,996

(22) Filed: May 31, 2007

(65) Prior Publication Data

US 2008/0007598 A1 Jan. 10, 2008

(30) Foreign Application Priority Data

Jul. 6, 2006 (KR) ..... 10-2006-0063504

(51) Int. Cl.
*B41J 2/045* (2006.01)

(52) U.S. Cl. ..... 347/68

(58) Field of Classification Search ..... 347/68, 347/69–72; 400/124.14–124.16; 310/363–366
See application file for complete search history.

(56) References Cited

U.S. PATENT DOCUMENTS

2005/0083379 A1* 4/2005 Chikamoto ..... 347/68

FOREIGN PATENT DOCUMENTS

KR 2003-50477 6/2003

* cited by examiner

*Primary Examiner*—K. Feggins
(74) *Attorney, Agent, or Firm*—Stanzione & Kim LLP

(57) ABSTRACT

A piezoelectric inkjet printhead that includes a flow channel plate; an ink flow channel that is formed in the flow channel plate and includes an ink inlet through which ink enters, a plurality of pressure chambers to which ink to be ejected is filled, a manifold which is a path for supplying ink from the ink inlet to the pressure chambers, a plurality of restrictors that connect the manifold to the pressure chambers, and a plurality of nozzles to eject ink from the pressure chambers to the outside; and a plurality of piezoelectric actuators formed on the flow channel plate to provide a driving power to each of the pressure chambers to eject ink to the outside, wherein the manifold includes a plurality of individual manifolds defined by a plurality of first barrier ribs, which respectively correspond to the pressure chambers. In the process of ejecting ink to the outside, ink that flows back from the pressure chambers towards the individual manifolds through the restrictors does not influence adjacent pressure chambers, thus preventing cross-talk.

11 Claims, 6 Drawing Sheets

PIEZOELECTRIC INKJET PRINTHEAD

CROSS-REFERENCE TO RELATED APPLICATIONS

This application claims the benefit of Korean Patent Application No. 10-2006-0063504, filed on Jul. 6, 2007, in the Korean Intellectual Property Office, the disclosure of which is incorporated herein in its entirety by reference.

BACKGROUND OF THE INVENTION

1. Field of the Invention

The present general inventive concept relates to a piezoelectric inkjet printhead, and more particularly, to a piezoelectric inkjet printhead having individual manifolds respectively corresponding to a plurality of pressure chambers to prevent cross-talk between the pressure chambers.

2. Description of the Related Art

An inkjet printhead is a device that prints a predetermined color image by ejecting minute droplets of ink on desired areas of a printing medium. Inkjet printheads can be generally classified into two types according to the ejection mechanism of ink droplets. The first type is a thermal inkjet printhead that ejects ink droplets using the expansion force of ink bubbles created using a heat source, and the second type is a piezoelectric inkjet printhead that ejects inkjet droplets using a pressure created by the deformation of a piezoelectric element.

FIG. 1 is a cross-sectional view of the configuration of a conventional piezoelectric inkjet printhead. Referring to FIG. 1, an ink flow channel including a manifold 2, a restrictor 3, a pressure chamber 4, and a nozzle 5 are formed inside of a flow channel plate 1, and a piezoelectric actuator 6 is formed on the flow channel plate 1. The manifold 2 is a common path for supplying ink to the pressure chamber 4 when the ink is supplied from an ink tank (not shown). The restrictor 3 is a path for supplying ink to each pressure chamber 4 from the manifold 2. The volume of the pressure chamber 4 is changed by the driving of the piezoelectric actuator 6, which causes a pressure change in the pressure chamber 4 for ejecting or receiving ink.

The flow channel plate 1 is formed by stacking a plurality of thin films which are mainly formed of a ceramic material, a metal material, or a synthetic resin material after the ink flow channel in the thin films is formed by processing each of the thin films. The piezoelectric actuator 6 is formed on the pressure chamber 4, and has a structure in which a piezoelectric film and electrodes for applying a voltage to the piezoelectric film are stacked. Accordingly, a portion of the flow channel plate 1 that forms an upper wall of the pressure chamber 4 functions as a vibrating plate 1*a* that is deformed by the piezoelectric actuator 6.

An operation of the conventional piezoelectric inkjet printhead having the above structure will now be described. When the vibrating plate 1*a* is deformed due to the driving of the piezoelectric actuator 6, the volume of the pressure chamber 4 is reduced, and as a result, ink in the pressure chamber 4 is ejected to the outside through the nozzle 5. Next, due to the driving of the piezoelectric actuator 6, the vibrating plate 1*a* is restored to the original position, and thus, the volume of the pressure chamber 4 increases. Due to the pressure change in the pressure chamber 4, ink enters the pressure chamber 4 from the manifold 2 through the restrictor 3.

FIG. 2 is an exploded perspective view of a conventional piezoelectric inkjet printhead which has been disclosed in Korean Patent Publication No. 2003-0050477 (U.S. Patent Publication No. 2003-0112300) by the applicant of the present general inventive concept.

The inkjet printhead of FIG. 2 has a structure in which three silicon substrates 30, 40, and 50 are stacked. Of the three silicon substrates 30, 40, and 50, a plurality of pressure chambers 32 having a predetermined depth are formed on a lower surface of the upper substrate 30. An ink inlet 31 connected to an ink tank (not illustrated) is formed through the upper substrate 30. The pressure chambers 32 are arranged in two rows on both sides of a manifold 41 formed in the middle substrate 40. A plurality of piezoelectric actuators 60 that provide a driving force to eject ink to each of the pressure chambers 32 are formed on an upper surface of the upper substrate 30. The middle substrate 40 includes the manifold 41 connected to the ink inlet 31. A plurality of restrictors 42 respectively connected to each of the pressure chambers 32 are formed on the both sides of the manifold 41. Also, the middle substrate 40 includes a plurality of dampers 43 perpendicularly formed through the middle substrate 40 at positions corresponding to each of the pressure chambers 32. The lower substrate 50 includes a plurality of nozzles 51 connected to the plurality of the dampers 43. Each of the nozzles 51 includes an ink inlet port 51*a* formed on an upper side of the lower substrate 50 and an ink ejection hole 51*b* formed on a lower side of the lower substrate 50. The ink inlet port 51*a* is formed in an inversed pyramid shape by anisotropic wet etching, and the ink ejection hole 51*b* is formed to have a predetermined diameter by dry etching.

As described above, in the inkjet printhead depicted in FIG. 2, one common manifold 41 corresponds to the plurality of pressure chambers 32. That is, the manifold 41 functions as a common flow channel to supply ink to the pressure chambers 32.

However, in the conventional piezoelectric inkjet printhead, when the pressure of each of the pressure chambers 32 is increased by the driving of the piezoelectric actuators 60, the ink in the pressure chambers 32 is ejected to the outside through the nozzles 51, and at the same time, flows back towards the manifold 41 through the restrictors 42. The ink that flows back affects other pressure chambers 32 through the common manifold 41, that is, it causes cross-talk between the pressure chambers 32. The cross-talk causes an unstable meniscus of ink in the nozzles 51 connected to adjacent pressure chambers 32, and thus, causes deviations in speed and volume of ink droplets ejected through each of the nozzles 51.

SUMMARY OF THE INVENTION

The present general inventive concept provides a piezoelectric inkjet printhead having individual manifolds defined by a barrier rib structure to correspond to respective pressure chambers, to prevent cross-talk therebetween.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a piezoelectric inkjet printhead including: a flow channel plate; an ink flow channel that is formed in the flow channel plate and includes an ink inlet through which ink enters, a plurality of pressure chambers into which ink to be ejected is filled, a manifold which is a path to supply ink from the ink inlet to the pressure chambers, a plurality of restrictors that connect the manifold to the pressure chambers, and a plurality of nozzles to eject ink from the pressure chambers to the outside; and a plurality of piezoelectric actuators formed on the flow channel plate to provide driving power to each of the pressure chambers to eject ink to the outside, wherein the manifold includes a plurality of individual manifolds defined by a plurality of first barrier ribs, which respectively correspond to the pressure chambers.

The pressure chambers and the individual manifolds may be arranged parallel to each other.

The ink inlet may include a plurality of individual ink inlets defined by a plurality of second barrier ribs. In this case, each of the individual ink inlets may be formed to correspond to two to four individual manifolds.

The piezoelectric inkjet printhead may further include an ink supply bezel formed on the flow channel plate, wherein the ink supply bezel comprises an ink supply hole connected to an ink tank and an ink reservoir where ink supplied from the ink tank through the ink supply hole is stored.

The ink reservoir may be formed on the ink inlet to be connected to the ink inlet, and ink stored in the ink reservoir may be supplied to the individual manifolds through the ink inlet.

The ink bezel may include an open space to expose the piezoelectric actuators to the outside.

The flow channel plate may include an upper substrate, a middle substrate, and a lower substrate. In this case, the pressure chambers may be formed to a predetermined depth in the lower surface of the upper substrate, the ink inlet may be formed vertically through the upper substrate, the manifold and the restrictors may be formed in the middle substrate, and the nozzles may be formed vertically through the lower substrate.

A plurality of dampers may be formed vertically through the middle substrate to connect the pressure chambers to the nozzles.

Each of the piezoelectric actuators may include a lower electrode formed on the upper substrate, a piezoelectric film formed to be positioned on each of the pressure chambers, and an upper electrode formed on the piezoelectric film to supply a voltage to the piezoelectric film.

The foregoing and/or other aspects and utilities of the present general inventive concept are achieved by providing an ink flow channel of a piezoelectric inkjet printhead, including an ink inlet through which ink enters from an ink tank, a plurality of pressure chambers into which ink to be ejected is filled and which generate pressure changes to eject the ink, a manifold including a plurality of sub-manifolds to supply ink from the ink inlet to respective ones of the pressure chambers, a plurality of restrictors each to connect one of the sub-manifolds to the respective pressure chamber, and a plurality of nozzles to eject the ink from the pressure chambers.

The foregoing and/or other aspects and utilities of the present general inventive concept are achieved by providing a piezoelectric inkjet printhead, including a flow channel plate; and an ink flow channel formed in the flow channel plate, the ink flow channel including a plurality of pressure chambers to which ink to be ejected is filled, a manifold corresponding to each one of the plurality of pressure chambers, each manifold to supply ink from an ink inlet to the respective pressure chamber, and a plurality of restrictors, each restrictor to connect a respective manifold to the corresponding pressure chamber.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
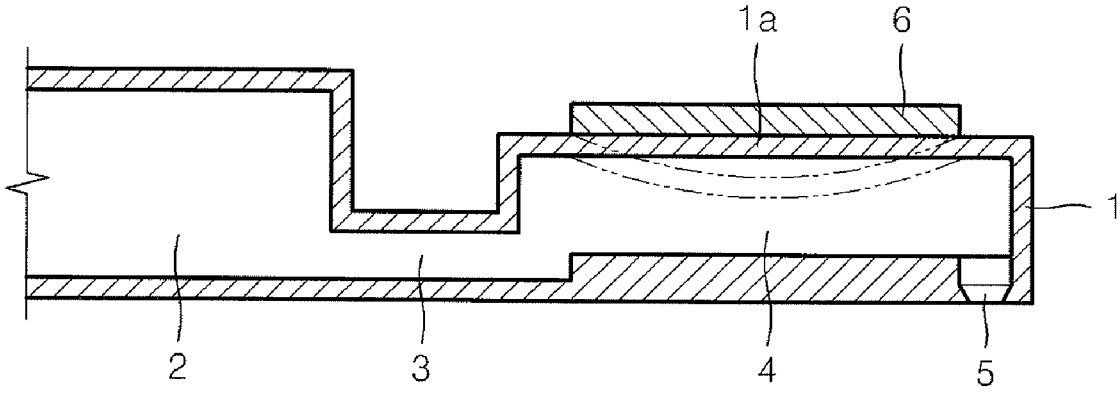
FIG. 1 (PRIOR ART)
FIG. 1 is a cross-sectional view of the configuration of a conventional piezoelectric inkjet printhead.
Figure 2:
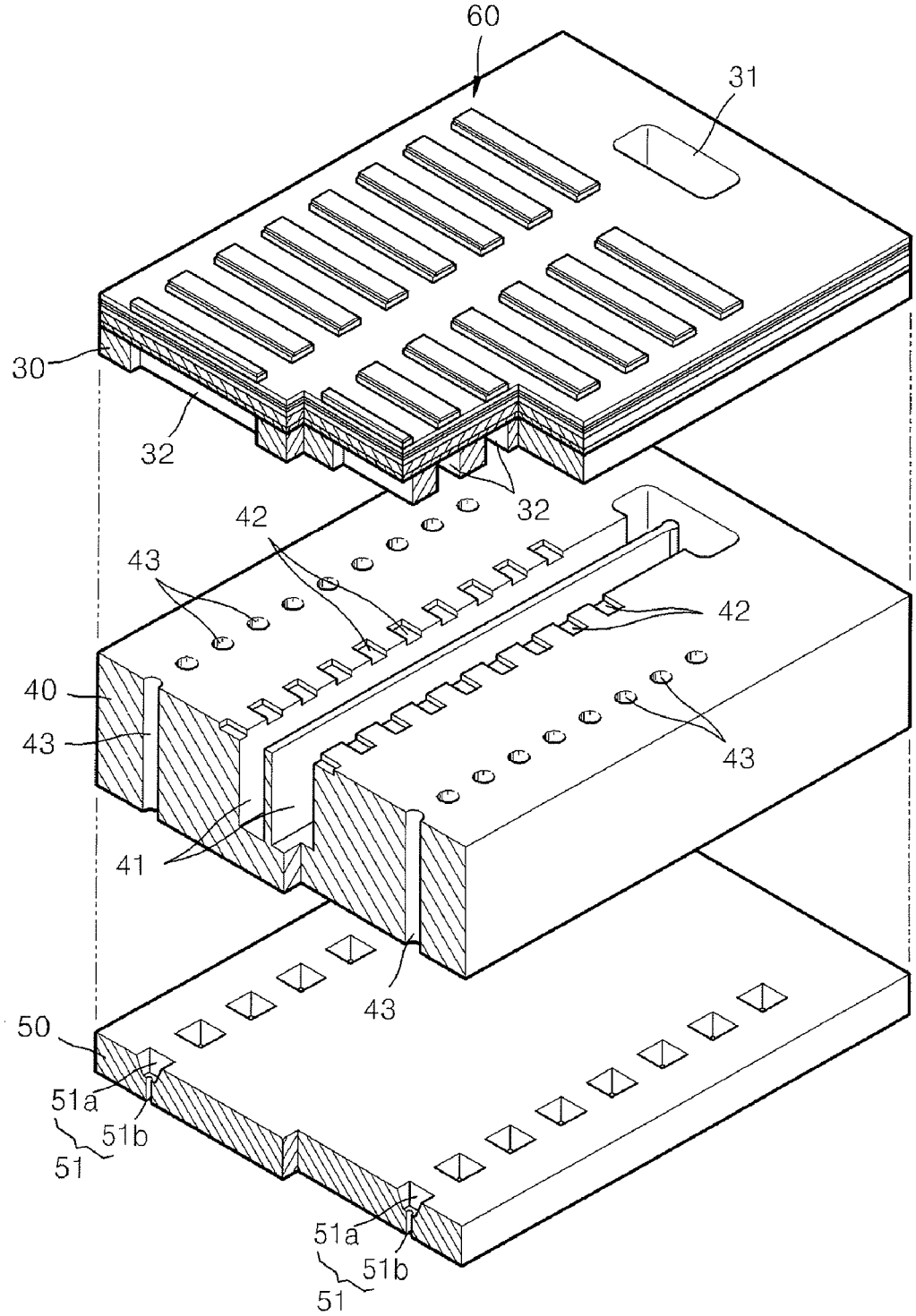
FIG. 2 (PRIOR ART)
FIG. 2 is an exploded perspective view of an example of a conventional piezoelectric inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
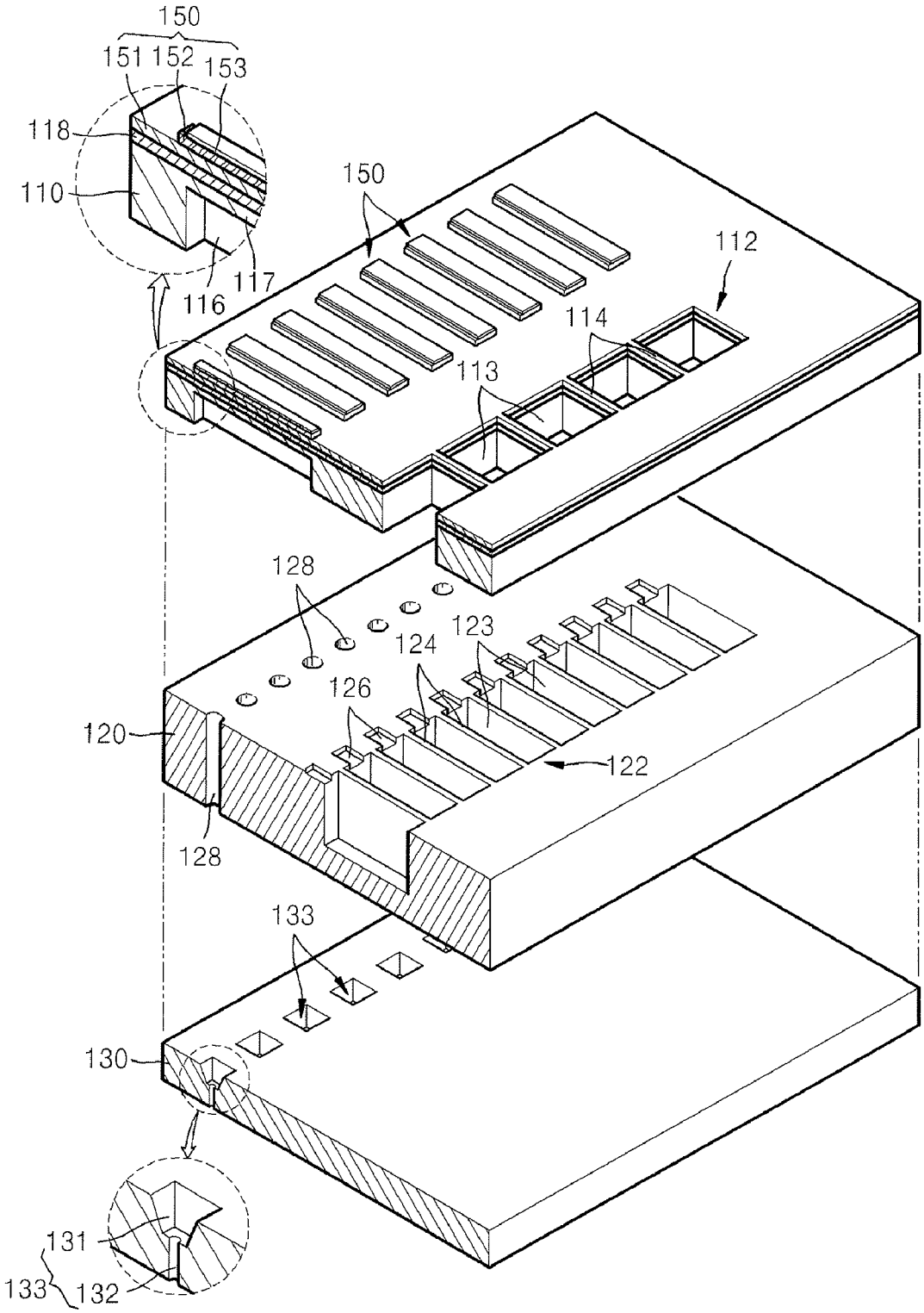
FIG. 3 is a partial cutaway exploded perspective view of a piezoelectric inkjet printhead according to an embodiment of the present general inventive concept.
Figure 4A:
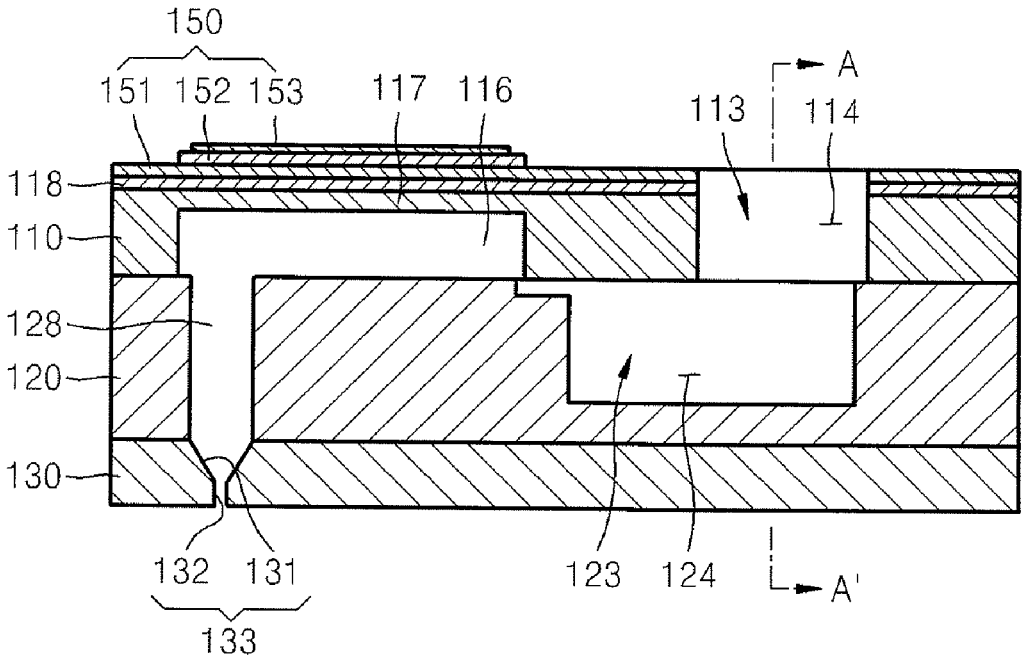
FIG. 4A is a vertical cross-sectional view cut in a lengthwise direction of pressure chambers of the assembled inkjet printhead of FIG. 3, according to an embodiment of the present general inventive concept.

FIG. 3 is a partial cutaway exploded perspective view of a piezoelectric inkjet printhead according to an embodiment of the present general inventive concept. FIG. 4A is a vertical cross-sectional view cut along a lengthwise direction of pressure chambers of the assembled inkjet printhead of FIG. 3, and FIG. 4B is a vertical cross-sectional view taken along line A-A' of FIG. 4A.

Figure 4B:
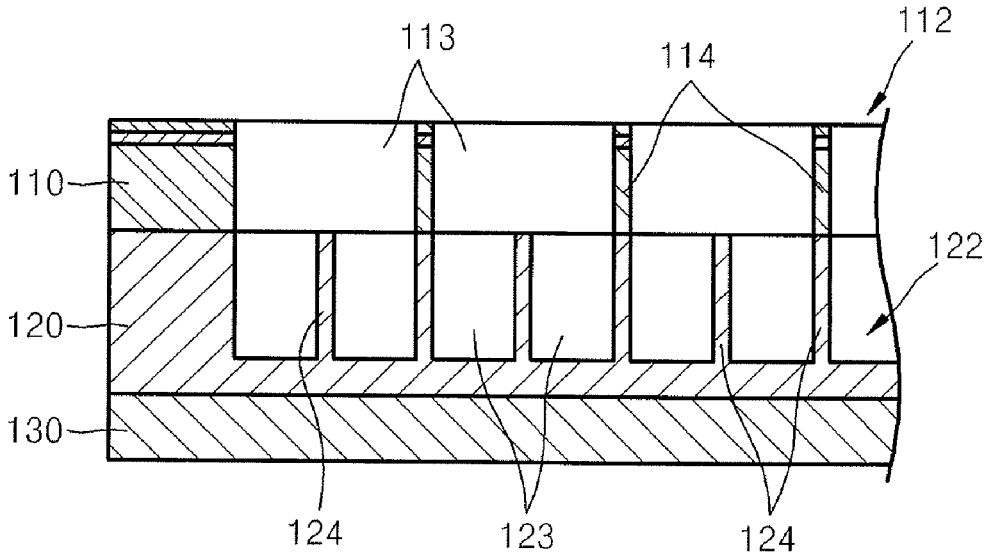
FIG. 4B is a vertical cross-sectional view taken along line A-A' of FIG. 4A, according to an embodiment of the present general inventive concept.

Referring to FIGS. 3, 4A, and 4B, a piezoelectric inkjet printhead according to an embodiment of the present general inventive concept includes an ink flow channel formed on flow channel plates 110, 120, and 130 and a plurality of piezoelectric actuators 150 formed on the flow channel plates 110, 120, and 130 to generate a driving force for ejecting ink.

The ink flow channel formed in the flow channel plates 110, 120, and 130 includes an ink inlet 112 through which ink enters from an ink tank (not illustrated), a plurality of pressure chambers 116 into which ink to be ejected is filled and that generate pressure changes to eject ink, a manifold 122 which is a path to supply ink from the ink inlet 112 to the pressure chambers 116, a plurality of restrictors 126 that connect the manifold 122 to the pressure chambers 116, and a plurality of nozzles 133 that eject ink from the pressure chambers 116. The ink flow channel can include a plurality of dampers 128 that connect the pressure chambers 116 to the nozzles 133.

In the above configuration of the ink flow channel, in order to prevent cross-talk between the pressure chambers 116, the manifold 122 includes a plurality of individual manifolds 123 to correspond to the pressure chambers 116. The structure of the individual manifolds 123 will be described later.

The flow channel plates 110, 120, and 130 can include an upper substrate 110, a middle substrate 120, and a lower substrate 130. In this case, the piezoelectric actuators 150 are formed on the upper surface of the upper substrate 110. The upper substrate 110, the middle substrate 120, and the lower substrate 130 can be a silicon substrate widely used to manufacture semiconductor integrated circuits.

The flow channel plates 110, 120, and 130 can include two substrates or four or more substrates. Thus, the flow channel plate 110, 120, and 130 depicted in FIGS. 3, 4A, and 4*b* is only an example. That is, an aspect of the present general inventive concept is not the configuration of the flow channel plate 110, 120, and 130, but is the configuration of the ink flow channel as described above.

More specifically, the pressure chambers 116 can be formed to a predetermined depth on a lower surface of the upper substrate 110. Portions of the upper substrate 110 that respectively constitute upper walls of the pressure chambers 116 function as vibrating plates 117 that vibrate due to the driving of the piezoelectric actuators 150. The pressure chambers 116 can be arranged in a row on a side of the manifold 122, and each can be formed in a rectangular parallelepiped shape whose side in a direction of ink flow is longer than the other side.

The manifold 122 can be formed to a predetermined depth in the upper part of the middle substrate 120 or can be formed vertically through the middle substrate 120. As described above, the manifold 122 includes the plurality of individual manifolds 123, and the individual manifolds 123 are respectively connected to the pressure chambers 116 through the restrictors 126. The pressure chambers 116 and the individual manifolds 123 can be formed parallel to each other. That is, in the piezoelectric inkjet printhead according to the present general inventive concept, the manifold 122 is not one common manifold that corresponds to the pressure chambers 116, but rather includes the individual manifolds 123 which respectively correspond to the pressure chambers 116.

As described above, since the individual manifolds 123 defined by a plurality of first barrier ribs 124 respectively correspond to the pressure chambers 116, although ink flows back from the pressure chambers 116 to the individual manifolds 123 through the restrictors 126 in the process of ejecting ink to the outside, the ink that flows back and the ink pressure are blocked by the first barrier ribs 124, and thus, cannot influence adjacent individual manifolds 123 and adjacent pressure chambers 116. Accordingly, the influences between adjacent pressure chambers 116 during ink ejection, that is, cross-talk, can be prevented.

The restrictors 126 are connection paths that connect the pressure chambers 116 to the individual manifolds 123. The restrictors 126 can be formed to a predetermined depth in the upper part of the middle substrate 120 or can be formed in various shapes different from the shape illustrated in FIG. 3.

The ink inlet 112 supplies ink from an ink tank (not illustrated) to the individual manifolds 123, and can be formed vertically through the upper substrate 110. The ink inlet 112 can be formed as one common inlet corresponding to the individual manifolds 123. However, the ink inlet 112 may include a plurality of individual ink inlets 113 defined by a plurality of second barrier ribs 114 like the manifold 122. In this case, the individual ink inlets 113 may be formed to correspond to every two to four individual manifolds 123. For example, as depicted in FIG. 4B, the ink inlet 112 can be defined by the second barrier ribs 114 so that one individual ink inlet 113 can correspond to two individual manifolds 123.

In this way, since the ink inlet 112 is defined as a plurality of individual ink inlets 113, the cross-talk described above can further be effectively prevented. Also, the flow rate of ink entering into the individual manifolds 123 can be uniformly controlled.

The plurality of dampers 128 can be formed vertically through the middle substrate 120 so that the dampers 128 can be respectively connected to the pressure chambers 116.

The plurality of nozzles 133 can be formed vertically through the lower substrate 130 at positions of the lower substrate 130 where the nozzles 133 are connected to the dampers 128. Each of the nozzles 133 can include an ink ejection hole 132 formed in a lower part of the lower substrate 130 and through which ink is ejected and an ink guiding unit 131 formed in an upper part of the lower substrate 130 to guide ink from the damper 128 to the ink ejection hole 132. The ink ejection hole 132 can be formed as a vertical hole having a predetermined diameter, and the ink guiding unit 131 can be formed in a quadrangular pyramid shape whose cross-sectional area is gradually reduced away from the damper 128 towards the ink ejection hole 132.

The piezoelectric actuators 150 can be formed on the upper substrate 110. An insulating film 118 can be formed between the upper substrate 110 and the piezoelectric actuators 150. If the upper substrate 110 is formed of silicon, the insulating film 118 can be a silicon oxide film. Each of the piezoelectric actuators 150 includes a lower electrode 151 that functions as a common electrode, a piezoelectric film 152 that deforms according to voltages applied thereto, and an upper electrode 153 that functions as a driving electrode. The lower electrode 151 can be formed on the entire surface of the insulating film 118 and can be a conductive metal material layer. The piezoelectric film 152 is formed on the lower electrode 151 and is positioned on each of the pressure chambers 116. The piezoelectric film 152 can be formed of a piezoelectric material, preferably, a lead zirconate titanate (PZT) ceramic material. The piezoelectric film 152 deforms due to a voltage applied thereto to vibrate the vibration plate 117 that constitutes the upper wall of the pressure chambers 116. The upper electrode 153 is formed on the piezoelectric film 152, and functions as a driving electrode that applies a voltage to the piezoelectric film 152.

When the upper substrate 110, the middle substrate 120, and the lower substrate 130 having the configuration as described above are combined with each other, a piezoelectric inkjet printhead according to the present general inventive concept can be manufactured. An ink flow channel in which the plurality of individual ink inlets 113, the plurality of individual manifolds 123, the plurality of restrictors 126, the plurality of pressure chambers 116, the plurality of dampers 128, and the plurality of nozzles 133 are sequentially connected are formed in the upper substrate 110, the middle substrate 120, and the lower substrate 130.

Figure 5:
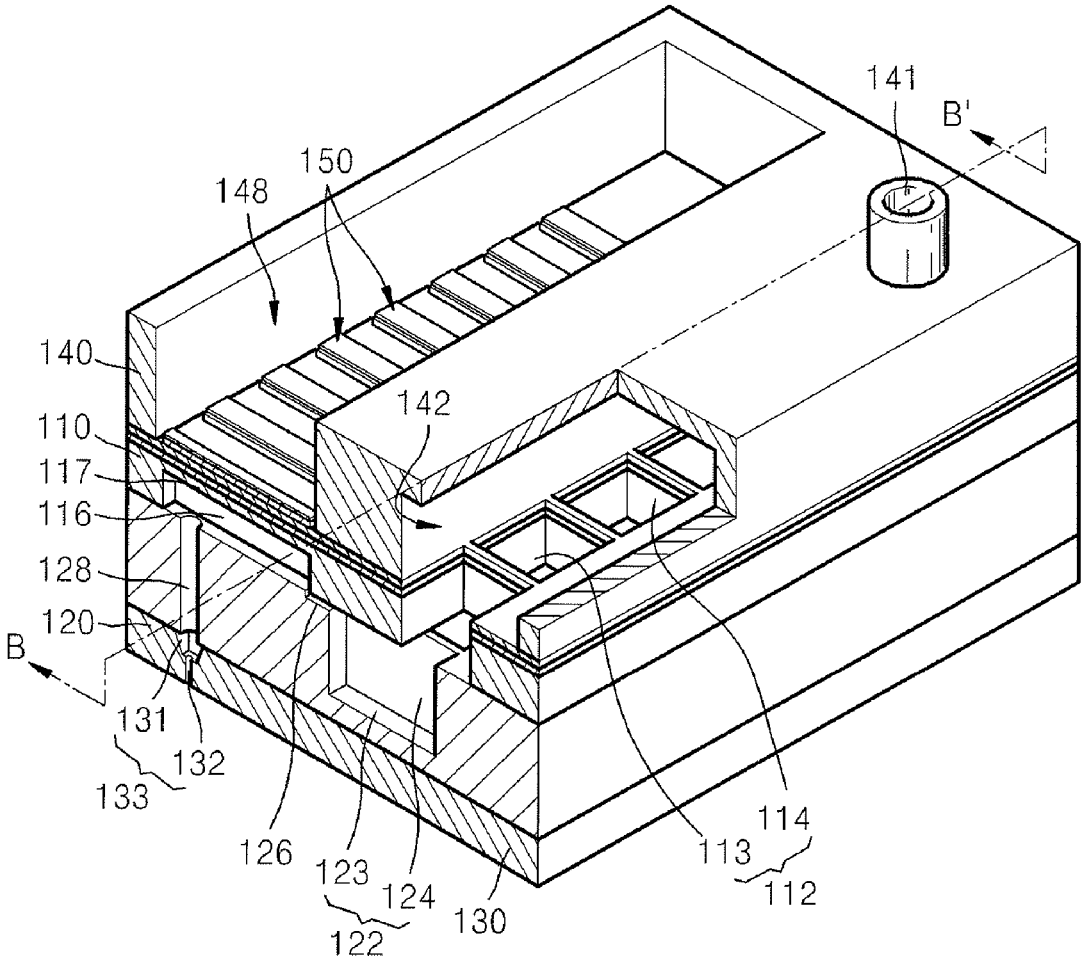
FIG. 5 is a partial cutaway perspective view of a piezoelectric inkjet printhead further having an ink supply bezel, according to an embodiment of the present general inventive concept.
Figure 6:
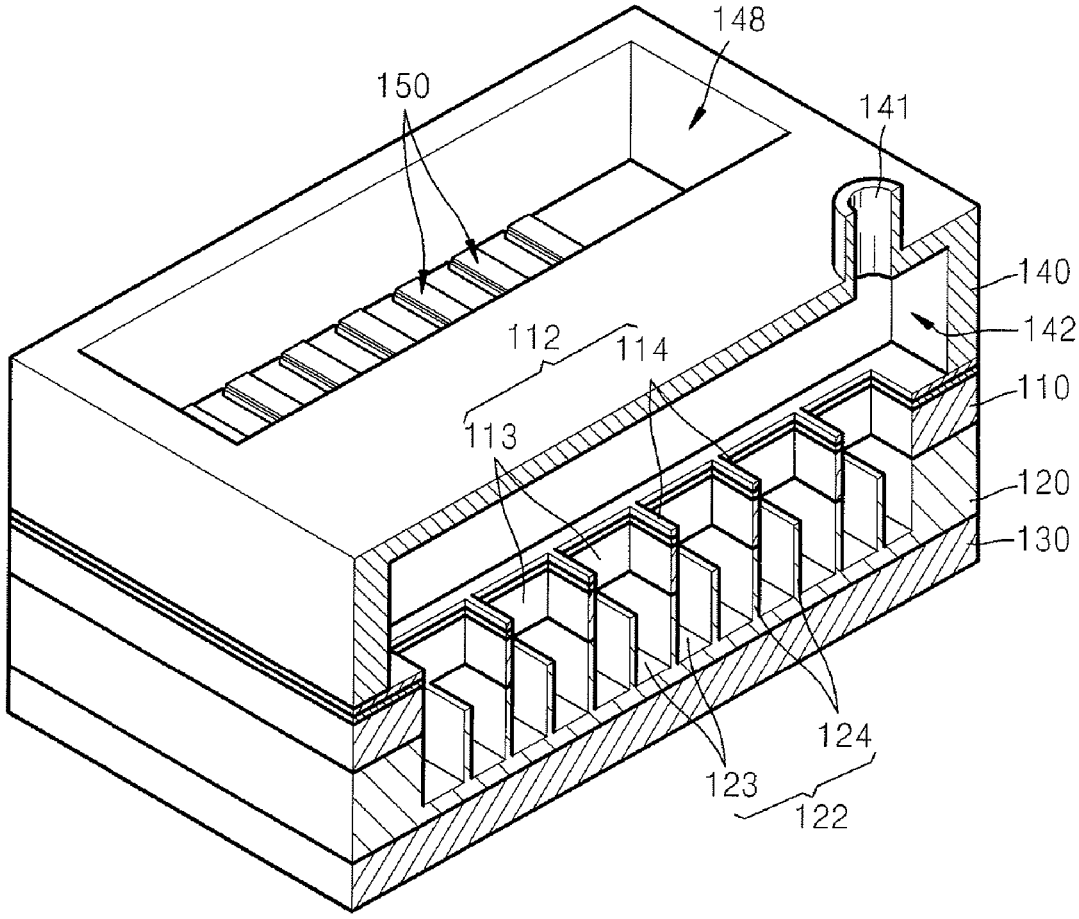
FIG. 6 is a perspective view taken along line B-B' of FIG. 5, according to an embodiment of the present general inventive concept.

FIG. 5 is a partial cutaway perspective view of a piezoelectric inkjet printhead further having an ink supply bezel, according to an embodiment of the present general inventive concept, and FIG. 6 is a perspective view taken along line B-B' of FIG. 5, according to an embodiment of the present general inventive concept.

Referring to FIGS. 5 and 6, a piezoelectric inkjet printhead according to an embodiment of the present general inventive concept can further include an ink supply bezel 140 that is coupled to the upper substrate 110. The ink supply bezel 140 includes an ink supply hole 141 connected to an ink tank (not illustrated) and an ink reservoir 142 in which ink supplied through the ink supply hole 141 is stored.

The ink reservoir 142 is formed above the ink inlet 112 which is formed in the upper substrate 110 to be connected to the ink inlet 112. The ink reservoir 142 can have a long shape corresponding to the ink inlet 112. The ink stored in the ink reservoir 142 is supplied to the individual manifolds 123 through the ink inlet 112.

The ink supply bezel 140 includes an open space 148 to expose the piezoelectric actuators 150 formed on the upper surface of the upper substrate 110. A flexible printed circuit (FPC) (not illustrated) to apply a voltage to the piezoelectric films 152 can be connected to the piezoelectric actuators 150 through the open space 148.

An operation of a piezoelectric inkjet printhead having the above configuration according to the present general inventive concept will now be described.

Ink supplied to the ink reservoir 142 from an ink tank (not illustrated) through the ink supply hole 141 enters the plurality of individual manifolds 123 defined by the first barrier ribs 124 through the individual ink inlets 113 defined by the second barrier ribs 114. The ink in the individual manifolds 123 is supplied to the plurality of pressure chambers 116 through the restrictors 126. In a state when the ink is filled in the pressure chambers 116, if a voltage is applied to the piezoelectric films 152 through the upper electrodes 153 of the piezoelectric actuators 150, the piezoelectric films 152 deform. As a result, the vibration plates 117 bend downwards. Due to the bending deformation of the vibration plates 117, the volume of the pressure chambers 116 is reduced, which increases the pressure in the pressure chambers 116. Thus, the ink in the pressure chambers 116 is ejected to the outside through the dampers 128 and the nozzles 133. At the same time, a portion of the ink in the pressure chambers 116 flows back towards the individual manifolds 123 through the restrictors 126. However, the backflow and pressure of the ink are blocked by the first barrier ribs 124, and thus, cannot influence adjacent individual manifolds 123 and adjacent pressure chambers 116.

Next, when the voltage applied to the piezoelectric films 152 of the piezoelectric actuators 150 is disconnected, the piezoelectric films 152 and the vibration plates 117 are restored to the original positions. Thus, the volumes of the pressure chambers 116 increase, and as a result, the pressures in the pressure chambers 116 are reduced. Due to the reduced pressure in the pressure chambers 116 and the surface tension due to meniscuses of ink in the nozzles 133, ink flows into the pressure chambers 116 from the individual manifolds 123 through the restrictors 126.

As described above, in a piezoelectric inkjet printhead according to the present general inventive concept, since a plurality of individual manifolds defined by a plurality of barrier ribs are provided corresponding to a plurality of pressure chambers, in the process of ejecting ink to the outside, ink that flows back from the pressure chambers towards the individual manifolds through restrictors does not influence adjacent pressure chambers, thereby preventing cross-talk between adjacent pressure chambers in the process of ejecting the ink to the outside. Therefore, the ejection performance of ink, that is, the volume of ink droplets and ejection speed of ink ejected from the pressure chambers through the nozzles, is uniform.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric inkjet printhead comprising:

a flow channel plate;

an ink flow channel that is formed in the flow channel plate and includes an ink inlet through which ink enters, a plurality of pressure chambers to which ink to be ejected is filled, a manifold which is a path to supply ink from the ink inlet to the pressure chambers, a plurality of restrictors that connect the manifold to the pressure chambers, and a plurality of nozzles to eject ink from the pressure chambers to the outside; and a plurality of piezoelectric actuators formed on the flow channel plate to provide a driving power to each of the pressure chambers to eject ink to the outside, wherein the manifold comprises a plurality of individual manifolds defined by a plurality of first barrier ribs, which respectively correspond to the pressure chambers.

2. The piezoelectric inkjet printhead of claim 1, wherein the pressure chambers and the individual manifolds are arranged parallel to each other.

3. The piezoelectric inkjet printhead of claim 1, wherein the ink inlet comprises a plurality of individual ink inlets defined by a plurality of second barrier ribs.

4. The piezoelectric inkjet printhead of claim 3, wherein each of the individual ink inlets is formed to correspond to two to four individual manifolds.

5. The piezoelectric inkjet printhead of claim 1, further comprising:

an ink supply bezel formed on the flow channel plate, wherein the ink supply bezel comprises an ink supply hole connected to an ink tank and an ink reservoir where ink supplied from the ink tank through the ink supply hole is stored.

6. The piezoelectric inkjet printhead of claim 5, wherein the ink reservoir is formed on the ink inlet to be connected to the ink inlet, and ink stored in the ink reservoir is supplied to the individual manifolds through the ink inlet.

7. The piezoelectric inkjet printhead of claim 5, wherein the ink bezel comprises an open space to expose the piezoelectric actuators to the outside.

8. The piezoelectric inkjet printhead of claim 1, wherein the flow channel plate comprises an upper substrate, a middle substrate, and a lower substrate.

9. The piezoelectric inkjet printhead of claim 8, wherein the pressure chambers are formed to a predetermined depth in the lower surface of the upper substrate, the ink inlet is formed vertically through the upper substrate, the manifold and the restrictors are formed in the middle substrate, and the nozzles are formed vertically through the lower substrate.

10. The piezoelectric inkjet printhead of claim 9, wherein a plurality of dampers are formed vertically through the middle substrate to connect the pressure chambers to the nozzles.

11. The piezoelectric inkjet printhead of claim 8, wherein each of the piezoelectric actuators comprises a lower electrode formed on the upper substrate, a piezoelectric film formed to be positioned on each of the pressure chambers, and an upper electrode formed on the piezoelectric film to supply a voltage to the piezoelectric film.

* * * * *